US005295425A

United States Patent [19]

Hediger

[11] Patent Number: 5,295,425

[45] Date of Patent: Mar. 22, 1994

[54] FLUID JET CUTTING APPARATUS

[76] Inventor: Peter Hediger, Fabrikweg 15, CH-5033 Buchs, Switzerland

[21] Appl. No.: 967,245

[22] Filed: Oct. 27, 1992

Related U.S. Application Data

[63] Continuation-in-part of Ser. No. 771,309, Oct. 2, 1991, abandoned.

[30] Foreign Application Priority Data

Oct. 10, 1990 [EP] European Pat. Off. ..... 90810780-8

[51] Int. Cl.[5] ..... B26F 3/00; B26D 7/00

[52] U.S. Cl. ..... 83/177; 83/941; 51/424; 51/425; 51/439

[58] Field of Search ..... 83/53, 177, 941; 51/319, 320, 410, 424, 425, 439; 239/227, 264

[56] References Cited

U.S. PATENT DOCUMENTS

| | | | |
|---|---|---|---|
| 3,927,591 | 12/1975 | Gerber | 83/177 |
| 4,058,040 | 11/1977 | Fisher | 83/177 |
| 4,112,797 | 9/1978 | Pearl | 83/177 |
| 4,312,254 | 1/1982 | Pearl | 83/177 |
| 4,728,379 | 3/1988 | Audi et al. | 83/177 X |
| 4,738,174 | 4/1988 | Bloomquist | 83/177 X |
| 5,199,342 | 4/1993 | Hediger | 83/177 |

*Primary Examiner*—Eugenia Jones
*Assistant Examiner*—Raymond D. Woods
*Attorney, Agent, or Firm*—Tarolli, Sundheim & Covell

[57] ABSTRACT

To cut or separate a workpiece, having a plain or curved surface, a jet-like fluid cutting medium is used. The cutting medium is ejected from a nozzle under high pressure and is directed towards the workpiece. The cutting medium is directed towards the surface of the workpiece not exactly perpendicularly, but with an angle deviation of between 0.1 and 0.3 degrees. An apparatus for performing such a cutting operation comprises a tube with a nozzle at its end through which the cutting medium is ejected. The nozzle is swivelably supported and the tube may be adjusted in X- and Y-direction such that the desired cutting angle may be controlled. In order to catch the fluid cutting jet, there is provided a grating assembly with an uneven surface which comprises apertures and is provided with a protective layer. The surface of the grating assembly is composed of strip portions forming the boundaries of grooves or channels which are filled with gravel or glass granules. The apparatus can be used for a dry cutting operation as well as for an underwater cutting operation.

7 Claims, 3 Drawing Sheets

FLUID JET CUTTING APPARATUS

This is a continuation-in-part of copending application Ser. No. 07/771,309 filed on Oct. 2, 1991, now abandoned.

BACKGROUND OF THE INVENTION

The present invention refers to an apparatus for cutting a plain, curved or arched workpiece by means of a beam-shaped fluid cutting medium ejected under high pressure out of a nozzle. This apparatus comprises a nozzle provided at the end of a tube-like member and means for providing a high-pressure fluid jet escaping from the nozzle.

It is well known in the prior art to cut or separate workpieces in a touchless method by means of a fluid jet, a gas jet or a laser beam, said jet or beam being directed towards the workpiece to be cut and being moved along a desired path. Probably the most common apparatus of this kind are the water jet cutting apparatus which use a water jet ejected from a nozzle under a pressure of up to 4000 bar. Thereby, it is possible to cut different kinds of workpieces, e.g. styropor, wood, fabrics, leather, rubber, textiles and many more.

It is also known in the prior art to admix an abrasive medium to this fluid jet, e.g. quartz, glass dust, corundum etc. in order to be able to cut harder materials like metal, glass, stone and the like.

According to the prior art, it has been taught to direct the fluid jet exactly perpendicularly towards the surface of the workpiece to be cut in order to get an exact and clean cut edge. This perpendicular position had to be maintained during the entire cutting process, even if the movement of the cutting jet is controlled by a CAD-machine.

However, experience has shown that this is not true; in this manner, it is not possible to achieve a cleanly cut edge. Particularly, the edges of the cut workpieces are not exactly cut, are irregularly and do not extend exactly perpendicularly to the plain surface of the workpiece.

As can be seen from FIG. 1, for example, in cutting a plate-like workpiece 1 by means of a fluid jet-like cutting medium 2 being ejected from a nozzle 3, it is not possible to achieve an exactly cut edge surface 4 because, as a result, the angle 5 is smaller or larger than 90° with reference to the surface 6 of the workpiece 1. This situation is schematically shown in FIG. 1. However, if it is required to very exactly cut a workpiece, the aforementioned disadvantages occur particularly aggravatingly. If, for example, precisely shaped parts have to be cut out of a workpiece according to a complicated shape which, thereafter, have to be inserted into correspondingly negative shaped workpieces or which have to be assembled with other precise workpieces, it is of paramount importance that the cut edges exactly run perpendicularly with regard to the workpieces.

For example, if cut-out parts, e.g. letters, are to be inserted into corresponding cut-outs of a base plate in order to manufacture inlays or high relief printings, the cut edges of the letters are allowed to be inclined inwards, but not outwards. With other words, deviations from the perpendicular direction can be tolerated in one, but only in one direction and not in the other direction. However, according to the prior art, deviations from the perpendicular direction of the cut edge surface can not be avoided because no reliable and economic method exists to provide an exactly perpendicular and clean cut edge.

The only method to avoid the aforementioned disadvantages known in the prior art was to drastically reduce the cutting speed during the cutting or separating process. A cut edge surface which is practically usable can be achieved, according to the prior art, if the theoretically possible cutting speed, depending on the material to be cut and on the cutting medium used, is not really exploited, but considerably reduced. However, such a proceeding results in a considerably loss of efficiency with the consequence that the final product becomes much more expensive. The reason is that the very expensive cutting apparatuses can not be used according to their theoretical possibilities.

The fluid jet discharged from the nozzle under high pressure is directed towards the top surface of the workpiece to be cut and the fluid jet nozzle is moved along a predetermined cutting path over the surface of the workpiece under the influence of a computerized control unit. The fluid jet cuts the workpiece and escapes from the workpiece at the rear side thereof. Since the fluid cutting jet, even after having cut the workpiece and escaping from the rear side thereof, comprises a very high residual energy, it is necessary to absorb said residual energy.

It has already been proposed in the prior art to provide a water-filled pool behind or below the workpiece to be cut in which the fluid cutting jet is caught. Thereby, the water-filled pool must have a thick and resistant wall because the fluid cutting jet impinges upon the walls of the water-filled pool. Particularly if an abrasive is admixed to the fluid cutting jet, it has not been possible to avoid that the wall of the water-filled pool is damaged or even destroyed.

In order to avoid damage or destruction of the wall, it has been proposed in the prior art to provide a bed of balls, comprising a tub filled with balls consisting of chromium steel or glass. Basically, such a design has proven to work well, but has the disadvantage that it is quite large and, consequently, heavy and expensive. Furthermore, a recycling of the abrasive is difficult to perform or even impossible.

OBJECTS OF THE INVENTION

It is an object of the invention to provide an apparatus for cutting a plain, curved or arched workpiece by means of a beam-shaped fluid cutting medium ejected under high pressure out of a nozzle means which apparatus enables a workpiece to be cut with a high cutting speed and with resulting clean and regular cut edge surfaces.

It is a further object of the invention to provide a fluid jet cutting apparatus including a catcher assembly for the fluid cutting jet escaping from the workpiece which catcher assembly is light in weight and very effective.

It is a still further object of the invention to provide a fluid jet cutting apparatus including a catcher assembly for the fluid cutting jet escaping from the workpiece which catcher assembly, nevertheless, is very sturdy and resistant and which cannot be damaged or destroyed even by fluid cutting jets containing an abrasive.

It is a still further object of the invention to provide a fluid jet cutting apparatus including a catcher assembly for the fluid cutting jet escaping from the workpiece which catcher assembly renders possible an easy and simple collection of the cutting fluid and of the abrasive in order to enable the cutting fluid and the abrasive to be used again.

SUMMARY OF THE INVENTION

To achieve these and other objects, the invention provides an apparatus for cutting a plain, curved or arched workpiece by means of a beam-shaped fluid cutting medium ejected under high pressure out of a nozzle means. This apparatus comprises a nozzle provided at the end of a tube-like member and means known in the art for providing a high-pressure fluid jet escaping from the nozzle.

Furthermore, means are provided by which an end portion of the tube-like member which is provided with the nozzle is pivotally supported and by which the tube-like member itself is supported in a guiding member which is pivotal in all directions.

Preferably, the means by which that end of the tube-like member which is provided with the nozzle is pivotally supported and by which the tube-like member itself is supported in a guiding member which is pivotal in all directions comprise a pyramid-shaped cage-like supporting member including a lower supporting plate for pivotally supporting the end portion of the tube-like member being provided with the nozzle as well as an upper guiding member adjustable in two directions running perpendicularly to each other by means of which the tube-like member is pivotal in all directions and displaceable in an axial direction.

The pyramid-shaped cage-like supporting member can comprise a supporting plate which is operationally connected to a CAD control means.

The apparatus further comprises a tub assembly including a fluid permeable supporting surface mounted to the tub assembly in a region of its open upper part for supporting a workpiece to be cut.

The tub assembly comprises a tub and a grating assembly mounted in the interior of the tub whereby the grating assembly has an uneven top surface provided with channels and including apertures for enabling the cutting fluid to pass the grating assembly and to flow into said tub. The uneven top surface of the grating assembly is covered by a protective layer and comprises a plurality of strip portions running in parallel directions, each of the strip portions extending in a different plane, two adjacent strip portions extending in two planes which form a predetermined angle therebetween and being connected with each other to form an apex.

BRIEF DESCRIPTION OF THE DRAWINGS

In the following, an embodiment of the apparatus of the invention will be described in greater detail, with reference to the accompanying drawings, in which.

DETAILED DESCRIPTION OF THE PREFERRED EMBODIMENTS

Figure 1:
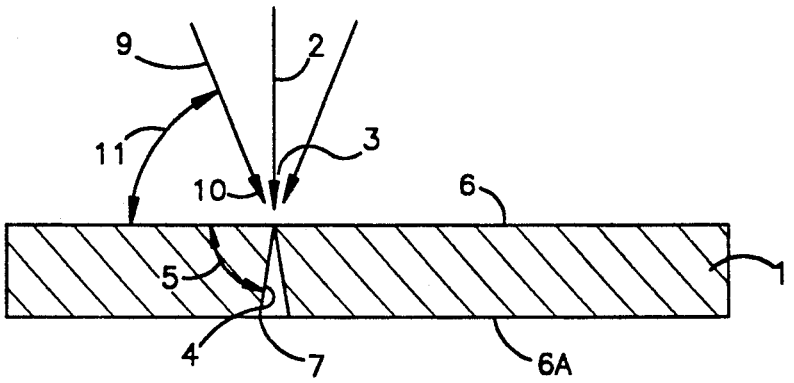
FIGS. 1 and 2 show purely schematic sketches to explain the method.

In order to explain the problems which are to be solved with the present invention, it has already been said hereinbefore in connection with FIG. 1 that, during cutting a panel 1 consisting e.g. of metal or stone and having a thickness of between a few millimeters up to a few centimetres, an exactly cut surface 4 cannot be realized because at least in the region of the cutting edge 7, i.e. where the cut surface 4 meets the surface 6*a* of the panel 1, the cut surface 4 does not run exactly perpendicular to the surface 6*a* of the panel. This is a real problem and the only way to avoid this problem is to drastically reduce the cutting speed. However, the result is that the manufacturing costs of an object cut by means of a beam-shaped fluid cutting medium are considerably higher.

Figure 2:
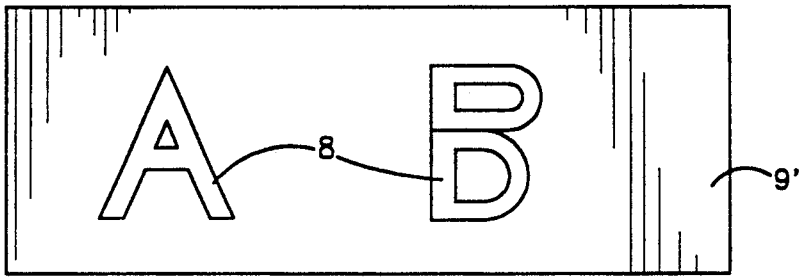

If for example letters 8 or other shapes have to be cut out of a workpiece 9' (FIG. 2) which thereafter have to be inserted into corresponding apertures in an other workpiece, it is not avoidable to manually finish the cutting edges not only of the letters etc. but also of the apertures in said other workpiece. Similar or even greater difficulties are encountered if constructional workpieces have to be cut from a raw panel which workpieces, thereafter, have to put together to an operative unit whereby the sizes and dimensions of the individual workpieces have to be met very exactly.

In order to avoid these difficulties and drawbacks, it is proposed according to the invention in a method in which a high pressure fluid jet is directed against a workpiece, e.g. a panel, and in which the fluid jet is moved along a desired path over the workpiece, that the axis of the high-pressure fluid jet runs not exactly perpendicularly to the surface (in the case of a plain workpiece) or to the tangential plane of the surface (in the case of a curved or arched workpiece), but encloses a slight angle with the perpendicular line.

Referring now again to FIG. 1, it can be seen that the panel 1, i.e. the workpiece, has a plain surface 6. In order to cut this panel 1, a fluid cutting medium, e.g. a water jet 9 escaping from a nozzle 10 is directed against the surface 6 of the panel 1. However, the axis of the water jet 9 runs not perpendicular to the surface 6 of the panel 1, but encloses an angle 11 with the plain surface 6 which is slightly smaller than 90°. It is understood that the purely schematic sketch in FIG. 1 is heavily exaggerated for the sake of clarity. In practice, the angle 11 can be in the region between 89.7° and 89.9°; with other words, the fluid jet 9 is directed against the surface 6 of the workpiece such that the angle between the axis 9 of the fluid jet and the line 2 running perpendicular to the surface 6 of the workpiece 1 amounts to between 0.1 and 0.3 degrees.

Surprisingly, it has been found that such a deviation of the angle results in a perfectly plain cut surface 4 running perfectly perpendicular with regard to the surface 6 of the panel 1, even if the greatest possible cutting speed is used which is determined by the material of the panel 1, by the cutting fluid and by the shape of the cutting line. This deviation from the aforementioned perpendicular orientation is maintained during the entire cutting process.

If the surface 6 of the workpiece 1 is not plain but curved or arched, then the reference for the direction of the cutting jet is the tangential plane to the curved or arched surface portion to be cut. With other words, the direction of the cutting jet is referenced to a line running perpendicularly to said tangential plane and the axis of the cutting jet is adjusted such that it deviates from this perpendicular line by an amount of between 0.1 and 0.3 degrees, depending of the material of the workpiece to be cut. This deviation is continuously adjusted to be always constant with reference to the perpendicular line to the tangential plane.

Figure 3:
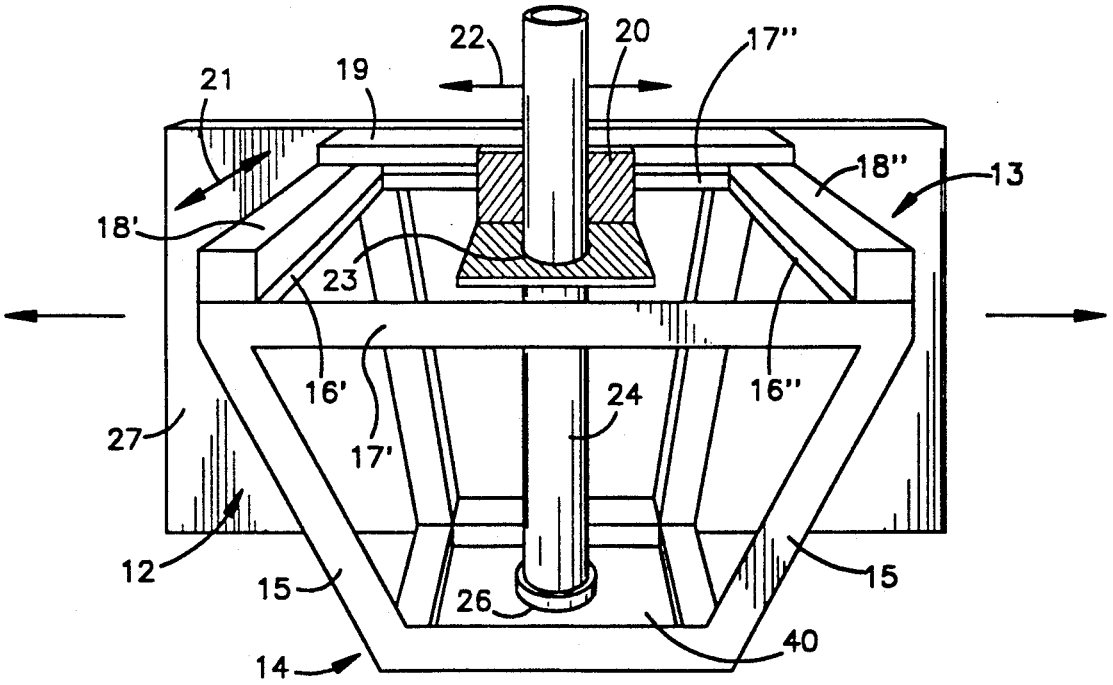
FIG. 3 shows a schematic partial view of an embodiment of the apparatus according to the invention.
Figure 4:
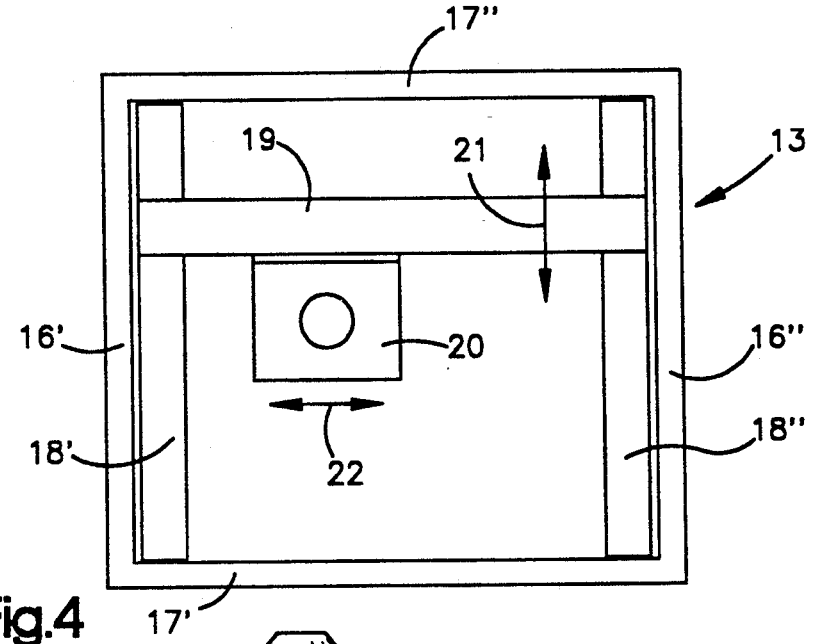
FIG. 4 shows a top view of the embodiment as shown in FIG. 3.

In order to perform the method according to the invention, there is provided an apparatus which is shown in FIG. 3 in a schematic partial view of an embodiment of the apparatus according to the invention and in FIG. 4 in a top view of the embodiment as shown in FIG. 3. The apparatus comprises a cage-like supporting member 12 having the shape of a pyramid. The cage-like supporting member 12 comprises an upper tetragonal frame 13, a similar lower tetragonal frame 14 as well as a number of connecting struts 15 which obliquely extends from the upper frame 13, down to the lower frame 14.

The upper tetragonal frame 13 consists of two pairs of opposite parallely running struts 16', 16'' and 17', 17'', respectively, whereby the struts 16' and 16'' each are provided with a guide member 18', 18'', respectively. A supporting bridge 19 is mounted in the guide members 18' and 18'' and is parallely displaceable in the direction of the double arrow 21. A L-shaped mounting plate 20 is mounted on the supporting bridge and displaceable therealong. The vertical portion of the mounting plate 20 is fixed to the supporting bridge 19 and can be displaced, together with the supporting bridge 19, in the direction of the double arrow 21. On the other hand, the L-shaped mounting plate can be displaced perpendicularly thereto, shown by the double arrow 22, along the supporting bridge 19.

Figure 6:
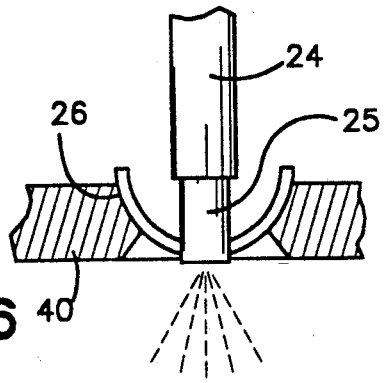
FIG. 6 shows a detail relating to FIG. 3 in an enlarged partial sectional view.

The horizontally extending portion of the L-shaped mounting plate 20 is provided with a circular aperture 23 through which a tube-like member 24 for the cutting medium extends; the tube-like member 24 is axially displaceable. The free end of the tube-like member 24 is provided with a nozzle 25 (cf. FIG. 6) through which the cutting medium, e.g. water, escapes with high pressure, for instance with a pressure of about 4000 bar, if required with an abrasive agent mixed to the water jet.

The tube-like member 24 is supported at its lower end in the region where the nozzle 25 is connected thereto. For this purpose, a plate-like member 40 is provided which comprises a bearing shell 26. Thereby, the tube-like member 24 is pressed against the bearing shell 26, and the bearing shell 26 as well as the tube-like member 24 is swivelable with reference to the plate-like member 40. Preferably, the tube-like member 24 is pressed against the bearing shell 26 by means of a (not shown) spring member.

Thus, as hereinbefore described, the tube-like member 24 can be adjusted as required, i.e. in the X-direction (direction of arrow 22) by displacing the mounting plate 20 along the supporting bridge 19 and in the Y-direction (direction of arrow 21) by the supporting bridge along the guide members 18' and 18''. By means of the provision of the bearing shell 26, the tube-like member 24 can be freely swivelled in the aperture 23.

The apparatus as hereinbefore described is preferably mounted on the mounting plate 27 which is controlled by a CAD-machine. This CAD-machine is programmed, in accordance with a given pattern, to perform the cutting operation. In the prior art, the cutting medium, i.e. the fluid jet, is directed to the material to be cut exactly perpendicularly. However, according to the present invention, the cutting medium, i.e. the fluid jet is not directed exactly perpendicularly to the surface of the material to be cut, but under a slight angle amounting to about 0.1 to 0.3 degrees. Thereby, the adjustment of the direction of the fluid jet is performed by means of the aforementioned adjusting means in the directions of the arrows 21 and 22. By the said deviation of 0.1 to 0.3 degrees, a cone is defined the generatrix of which fulfilling the desired requirements. Usually, according to the invention, it doesn't matter which generatrix is chosen, and it is also possible, by means of a trial-and-error method, to choose the most suitable generatrix from the sheaf thereof.

It is also possible to perform a displacement in a third dimension (Z-axis) by providing means for a height adjustment of the mounting plate 27. Such height adjustment can be coordinated with the movements controlled by the CAD-machine.

Figure 5:
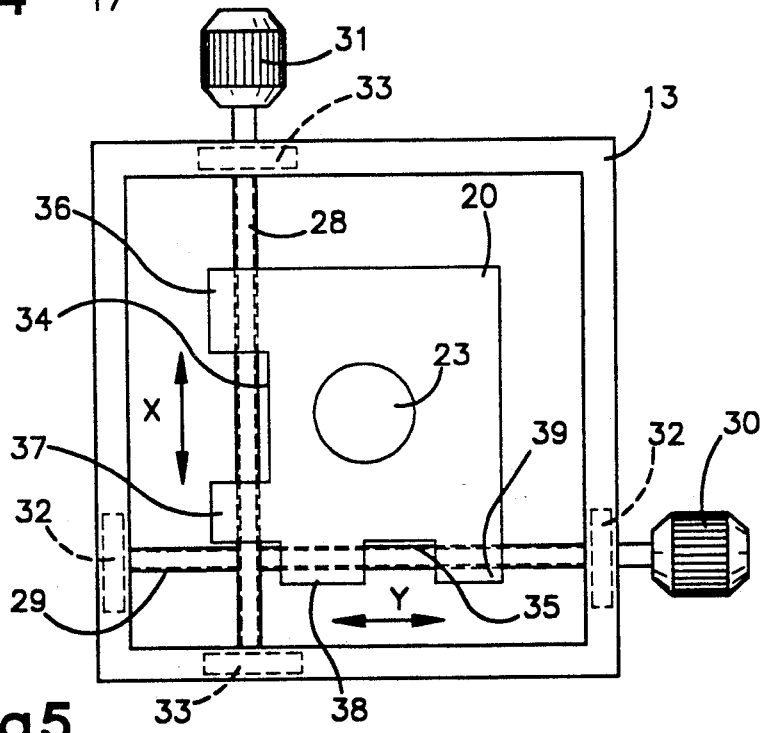
FIG. 5 shows a similar view as in FIG. 4 in another embodiment.

A further embodiment of the invention is shown in FIG. 5. Thereby, a frame 13 is provided, said frame 13 comprising a pair of spindles, e.g. a first spindle 28 and a second spindle 29. The first spindle 28 extends in the X-direction and the second spindle 29 extends in the Y-direction, perpendicular to the X-direction. Both spindles 28 and 29 are provided with a driving motor 30 and 31, respectively, adapted to rotate the spindles.

The first spindle 28 running in X-direction is supported, at both ends, in bearings 33, e.g. roller bearings, plain bearings or the like such that it is parallely displaceable in the Y-direction within the frame 13. The second spindle 29 running perpendicularly to the first spindle 28 in Y-direction is supported, at both ends, in bearings 32, e.g. roller bearings, plain bearings or the like such that it is parallely displaceable in the X-direction within the frame 13.

The mounting plate 20 comprises two sides 34 and 35 running perpendicularly to each other. These sides 34 and 35 are operatively connected to the spindles 28 and 29. For this purpose, these sides 34 and 35 are provided with protrusions 36 and 37; and 38 and 39, respectively, having a threaded bore in which the two spindles 28 and 29, respectively, engage. The spindles 28 and 29 are axially fixed. Thus, by rotating the spindles 28 by means of the motor 31, the mounting plate 20 is displaced in X-direction. Correspondingly, by rotating the spindles 29 by means of the motor 30, the mounting plate 20 is displaced in X-direction. In this manner, by means of the aforementioned CAD-machine which controls the motors 30 and 31, a very exact displacement of the mounting plate 20 with the circular aperture 23 and, thereby, of the direction of the fluid jet, can be achieved.

Figure 7:
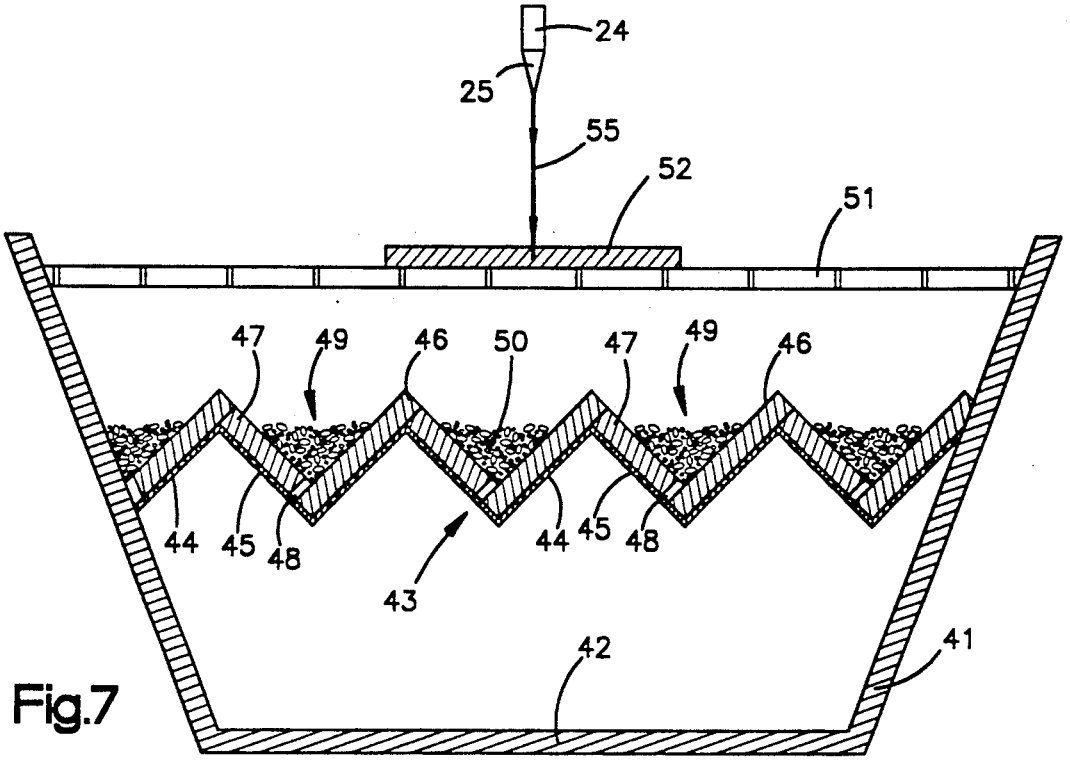
FIG. 7 shows a schematic cross sectional view of the tub assembly of the fluid cutting apparatus.

According to FIG. 7, the apparatus further comprises a tub 41 having a bottom wall 42. At a certain distance above the bottom wall 42, there is provided a grating assembly 43. The grating assembly 43 is composed of a plurality of strip portions 44 and 45, all of them running in directions parallel to each other, but extending in different planes. Two adjacent strip portions 44 and 45 always extend in two planes which enclose a certain angle therebetween, with the result that grooves or channels 49 are formed which run longitudinally along the strip portions 44 and 45. The strip portions 44 and 45 can be part of a perforated sheet metal plate which is shaped as hereinbefore described, e.g. by means of a press brake, to form the above mentioned grooves or channels 49.

Figure 8:
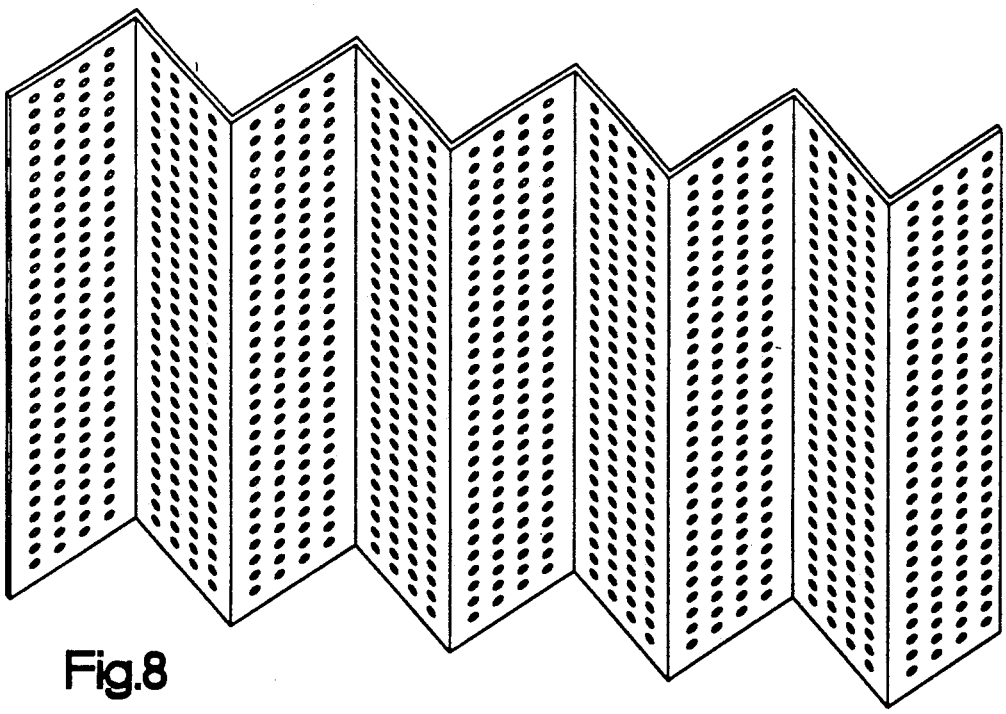
FIG. 8 shows another embodiment of the grating assembly.

The grating assembly 43 can have a shape different from the shape shown in the drawing and described hereinabove. Particularly, it can consist of corrugated sheet metal material as shown in FIG. 8. Essential is that the grating assembly 43 generally does not have an even surface.

The strip portions 44 and 45 are provided with a protective layer. In the present example, the protective layer is composed of correspondingly shaped and dimensioned strip-like ceramic plates 46 and 47 which cover the strip portions 44 and 45 such that at the locations where two ceramic plates 46 and 47 meet each other in the region of the bottom of the grooves or channels 49, an aperture 48 is formed. Thus, the strip portions 44 and 45 or the ceramic plates 46 and 47 form the boundaries of the grooves or channels 49. Preferably, the grooves or channels 49 are at least partially filled with gravel or with glass granules 50.

In the region of the upper part of the tub 41, above the grating assembly 43, there is provided a grid member 51 adapted to receive a workpiece 52 to be cut. The fluid jet cutting tool is mounted above the grid member 51 and includes a jet nozzle 25 directed toward the fluid permeable supporting grid 51. The fluid jet cutting tool is mounted on a supporting assembly which is displaceable in at least two directions running perpendicular to each other as explained hereinbefore in connection with FIGS. 1 to 6.

As has been explained above, the grating assembly 43 comprising the perforated and shaped plate is never directly exposed to the cutting jet 55 because the cutting jet 55 never hits the grating assembly 43 perpendicularly to its surface, even if the nozzle 25 is tilted. On the other hand, the grating assembly 43 is always hit by the fluid jet 55, but is not subjected to a high stress and cannot be destroyed. Furthermore, the gravel or glass 50 provided in the grooves or channels 49 additionally decreases the destructive effect of the cutting jet 55 to the walls of the tub 41. Therefore, it is possible to operate the apparatus with very high pressure and with abrasive admixed to the fluid cutting jet 55 whereby the cutting jet 55 looses its residual energy to a great extent due to the gravel or glass 50 provided in the grooves or channels 49. Thereafter, the cutting fluid passes the apertures 48 as well as the perforated strip portions 44 and 45, respectively, and flows into the tub 41 where the cutting fluid and the abrasive are collected to be used again.

With the apparatus as described above, it is possible to perform alternatively a dry cutting operation or an underwater cutting operation. In performing an underwater cutting operation, the tub 41 is filled with water to such an extent that the grating assembly 43 including the ceramic plates 46 and 47 as well as the gravel or glass 50 in the grooves or channels 49 are below the water level. It is even possible to fill the tub 41 to such an extent that also the grid member 51 and the workpiece 52 are below the water level such that the cutting operation is performed completely underwater. This operation has the great advantage that the cutting is performed with low noise and, additionally, with many materials, the quality of the cut is increased. Furthermore, the development of dust is avoided. However, an underwater cutting operation cannot be performed with each and every material; particularly, porous materials cannot be cut underwater.

In performing a dry cutting operation, the cutting fluid is collected in the tub 41 and continuously removed therefrom, if necessary conditioned and used for cutting again.

What is claimed is:

1. An apparatus for cutting a plain, curved or arched workpiece by a fluid cutting medium ejected under high pressure, said apparatus comprising:

a tube-like member having an end portion and an inlet for receiving the fluid cutting medium, said tube-like member having an axis and being displaceable along said axis;

nozzle means connected at said end portion of said tube-like member;

means for ejecting the fluid cutting medium to provide a high pressure fluid jet escaping from said nozzle means to cut the workpiece;

guiding means including a guiding member adjustable in two directions extending perpendicular to each other for enabling said tube-like member to displace along said axis;

supporting means for supporting for pivotal movement said end portion of said tube-like member at which said nozzle means is connected;

a tub assembly for supporting the workpiece to be cut by the high pressure fluid jet escaping from said nozzle means and for collecting the fluid cutting medium;

said tub assembly comprising a tub including a bottom wall portion and side wall portions extending from said bottom wall portion to define an interior space of said tub and an opening of said tub;

said tub assembly comprising a fluid permeable supporting surface for supporting the workpiece to be cut, said fluid permeable supporting surface being mounted between said side wall portions of said tub and in the vicinity of said opening of said tub;

said tub assembly comprising a grating assembly mounted between said side wall portions of said tub and in the interior space of said tub, said grating assembly being disposed between said fluid permeable supporting surface and said bottom wall portion of said tub;

said grating assembly including a plurality of strip portions and for receiving the fluid cutting medium from said nozzle means, said plurality of strip portions including a first series of parallel strip portions lying in different planes and extending in a first direction and a second series of parallel strip portions lying in different planes and extending in a second direction which is transverse to said first direction, the strip portions of said first series of parallel strip portions being disposed alternately between the strip portions of said second series of parallel strip portions;

each of the strip portions of said first series of parallel strip portions and an adjacent strip portion of said second series of parallel strip portions forming a channel having a predetermined angle between the adjacent strip portions, at least one of the adjacent strip portions forming the channel having an aperture for allowing the fluid cutting medium to pass therethrough and thereby to collect in the interior space of said tub; and a protective layer disposed between said fluid permeable supporting surface and said strip portions and for protecting said strip portions when said grating assembly receives the fluid cutting medium.

2. An apparatus according to claim 1 wherein said protective layer comprises (i) a first series of parallel strip-like ceramic panels lying in different planes and extending in said first direction and (ii) a second series of parallel strip-like ceramic panels lying in different planes and extending in said second direction, the strip-like ceramic panels of said first series of parallel strip-like ceramic panels being disposed alternately between the strip-like ceramic panels of said second series of parallel strip-like ceramic panels, two adjacent strip-like ceramic panels defining an aperture therebetween for allowing fluid cutting medium to pass therethrough.

3. An apparatus according to claim 2 wherein said strip-like ceramic panels and said strip portions form the boundaries of said channels.

4. An apparatus according to claim 1 wherein said supporting means comprises a pyramid-shaped cage-like supporting member including a mounting plate which is operationally connected to a CAD control means.

5. An apparatus according to claim 1 wherein said channels are at least partly filled with gravel or with glass granules.

6. An apparatus for cutting a plain, curved or arched workpiece by fluid cutting medium ejected under high pressure, said apparatus comprising:

a tube-like member having an end portion and an inlet for receiving the fluid cutting medium, said tube-like member having an axis and being displaceable along said axis;

nozzle means connected at said end portion of said tube-like member;

means for ejecting the fluid cutting medium to provide a high pressure fluid jet escaping from said nozzle means to cut the workpiece;

guiding means including a guiding member adjustable in two directions extending perpendicular to each other for enabling said tube-like member to displace along said axis;

supporting means for supporting for pivotal movement said end portion of said tube-like member at which said nozzle means is connected;

a tub assembly for supporting the workpiece to be cut by the high pressure fluid jet escaping from said nozzle means and for collecting the fluid cutting medium;

said tub assembly comprising a tub including a bottom wall portion and side wall portions extending from said bottom wall portion to define an interior space of said tub and an opening of said tub;

said tub assembly comprising a fluid permeable supporting surface for supporting the workpiece to be cut, said fluid permeable supporting surface being mounted between said side wall portions of said tub and in the vicinity of said opening of said tub;

said tub assembly comprising a grating assembly mounted between said side wall portions of said tub and in the interior space of said tub, said grating assembly being disposed between said fluid permeable supporting surface and said bottom wall portion of said tub;

said grating assembly comprising a single piece of perforated panel and for receiving the fluid cutting medium from said nozzle means, said single piece of perforated panel having a number of apertures, said single piece of perforated panel being folded to form a first series of parallel strip portions lying in different planes and extending in a first direction and a second series of parallel strip portions lying in different planes and extending in a second direction which is transverse to said first direction, the strip portions of said first series of parallel strip portions being disposed alternately between the strip portions of said second series of parallel strip portions;

each of the strip portions of said first series of parallel strip portions and an adjacent strip portion of said second series of parallel strip portions forming a channel having a predetermined angle between the adjacent strip portions, at least one of the adjacent strip portions forming the channel having at least one of said apertures of said single piece of perforated panel for allowing the fluid cutting medium to pass therethrough and thereby to collect in the interior space of said tub; and a protective layer disposed between said fluid permeable supporting surface and said strip portions and for protecting said strip portions when said grating assembly receives the fluid cutting medium.

7. An apparatus for cutting a plain, curved or arched workpiece by a fluid cutting medium ejected under high pressure, said apparatus comprising:

a tube-like member having an end portion and an inlet for receiving the fluid cutting medium, said tube-like member having an axis and being displaceable along said axis;

nozzle means connected at said end portion of said tube-like member;

means for ejecting the fluid cutting medium to provide a high pressure fluid jet escaping from said nozzle means to cut the workpiece;

guiding means including a guiding member adjustable in two directions extending perpendicular to each other for enabling said tube-like member to displace along said axis;

supporting means for supporting for pivotal movement said end portion of said tube-like member at which said nozzle means is connected;

a tub assembly for supporting the workpiece to be cut by the high pressure fluid jet escaping from said nozzle means and for collecting the fluid cutting medium;

said tub assembly comprising a tub including a bottom wall portion and side wall portions extending from said bottom wall portion to define an interior space of said tub and an opening of said tub;

said tub assembly comprising a fluid permeable supporting surface for supporting the workpiece to be cut, said fluid permeable supporting surface being mounted between said side wall portions of said tub and in the vicinity of said opening of said tub;

said tub assembly comprising a grating assembly mounted between said side wall portions of said tub and in the interior space of said tub, said grating assembly being disposed between said fluid permeable supporting surface and said bottom wall portion of said tub;

said grating assembly comprising a single continuous piece of corrugated sheet metal material and for receiving the fluid cutting medium from said nozzle means, said single continuous piece of corrugated sheet metal material having a number of apertures, said single continuous piece of corrugated sheet metal material including a first series of parallel strip portions lying in different planes and extending in a first direction and a second series of parallel strip portions lying in different planes and extending in a second direction which is transverse to said first direction, the strip portions of said first series of parallel strip portions being disposed alternately between the strip portions of said second series of parallel strip portions;

each of the strip portions of said first series of parallel strip portions and an adjacent strip portion of said second series of parallel strip portions forming a channel having a predetermined angle between the adjacent strip portions, at least one of the adjacent strip portions forming the channel having at least one of said apertures of said single continuous piece of corrugated sheet metal material for allowing the fluid cutting medium to pass therethrough and thereby to collect in the interior space of said tub; and a protective layer disposed between said fluid permeable supporting surface and said strip portions and for protecting said strip portions when said grating assembly receives the fluid cutting medium.

* * * * *